United States Patent [19]

Snyder et al.

[11] Patent Number: 4,888,253

[45] Date of Patent: Dec. 19, 1989

[54] HIGH STRENGTH CAST+HIP NICKEL BASE SUPERALLOY

[75] Inventors: Sherman M. Snyder, West Hartford; Edgar E. Brown, South Windsor, both of Conn.

[73] Assignee: United Technologies Corporation, Hartford, Conn.

[21] Appl. No.: 814,695

[22] Filed: Dec. 30, 1985

[51] Int. Cl.[4] ..... B32B 15/00

[52] U.S. Cl. ..... 428/680; 148/2; 148/12.7 N; 148/410; 148/428

[58] Field of Search ..... 420/448, 446, 447; 148/2, 3, 11.5 N, 12.7 N, 13, 410, 428; 428/680

[56] References Cited

U.S. PATENT DOCUMENTS

| | | | |
|---|---|---|---|
| 3,046,108 | 7/1962 | Eiselstein | 420/448 |
| 3,758,295 | 9/1973 | Morley et al. | 420/448 |
| 4,231,795 | 11/1980 | Gibson et al. | 420/448 |

OTHER PUBLICATIONS

R. Vincent, "Precipitation Around Welds in the Nickel-Base Superalloy, Inconel 718", Acta Metallurgica, vol. 33, No. 7, pp. 1205-1216 (1985).

R. C. Hall, "The Metallurgy of Alloy 718", Journal of Basic Engineering, pp. 511-516 (Sep. 1967).

H. L. Eiselstein, "Metallurgy of a Columbium-Hardened Nickel-Chromium-Ion Alloy", American Society for Testing and Materials, Special Technical Publication No. 369, Advances in the Technology of Stainless Steels and Related Alloys, Philadelphia, Apr. 1965.

H. J. Wagner and A. M. Hall, "Physical Metallurgy of Alloy 718", Defense Metal Information Center Report 217, Battelle Memorial Institute, Columbus, Jun. 1, 1965.

*Primary Examiner*—R. Dean

[57] ABSTRACT

A nickel base superalloy composition useful in the cast+HIP+heat treated condition is described. Articles having the invention composition have properties which are significantly better than similarly processed IN718 articles. This is achieved by modifying the chromium, columbium, and titanium contents in the alloy composition, relative to the IN718 composition.

6 Claims, 3 Drawing Sheets

100X

Alloy 9 : 13%Cr

100X

Alloy 13 : 19%Cr

HIGH STRENGTH CAST+HIP NICKEL BASE SUPERALLOY

CROSS REFERENCE

The invention described in this application is related to the invention described in the co-pending, commonly assigned application, LAVES FREE CAST + HIP NICKEL BASE SUPERALLOY, Attorney Docket No. EH-8047, filed by S. M. Snyder and E. E. Brown on the same day as this application was filed.

TECHNICAL FIELD

This invention relates to cast nickel base superalloys, and in particular to compositions useful in casting large structural components for use in gas turbine engines.

BACKGROUND ART

Superalloys are materials, usually based on nickel, cobalt, or iron, which have useful mechanical properties at temperatures on the order of 1,000° F. and above. Because of their desirable properties, superalloys have found numerous applications in gas turbine engines. In general, components for gas turbine engines are either cast, fabricated by powder metallurgy techniques, or are fabricated and machined from thermo-mechanically worked product forms such as forgings, plate, and sheet. Some alloy compositions particularly useful in wrought form are described in U. S. Pat. Nos. 3,046,108, 3,758,295 and 4,231,795. It is a result of thermo-mechanical working that articles having such compositions achieve their desired microstructure and properties. Without such processing these prior art compositions may not be useful. See, e.g., the discussion in the '108 patent at column 3 starting at line 31. The microstructure and properties of wrought products often are not realized in large, complex castings because of a slow cooling rate during solidification of the castings, which results in a coarse grain size and segregation. While fabrication and machining of complex components from various thermally-mechanically worked product forms is possible, the process is labor intensive and produces much scrap. For these reasons, it is quite expensive, and the use of castings is preferred. Sometimes, castings are hot isostatically pressed (HIP'd) to enhance properties.

The well known nickel base superalloy INCONEL® Alloy 718 has been used by the gas turbine engine industry for many years. INCONEL is a registered trademark of The International Nickel Company, Inc. Hereinafter, INCONEL Alloy 718 will be referred to as IN718. This alloy is described in Aerospace Materials Specifications (AMS) 5663 (wrought materials) and 5383 (cast materials). According to AMS 5383, the composition range for IN718 is, by weight percent, 50–55 Ni, 17–21 Cr, 4.75–5.5 Cb+Ta, 2.8–3.3 Mo, 0–1 Co, 0.65–1.15 Ti, 0.4–0.8 Al, 0.0–1.75 Al+Ti, 0.0–0.35 Si, 0.0–0.006 B, 0.0–0.3 Cu, 0.0–0.015 S, 0.0–0.015 P, 0.0–0.35 Mn, 0.0–0.10 C, with the balance Fe.

Advanced engine designs have been proposed which require an alloy which can be cast to near-net shape into large complex components, with the added requirement that the alloy have greater tensile properties than IN718. Cast components made of such a new alloy could replace components which are currently fabricated from wrought IN718 products, with no resultant weight penalty and at a cost savings. Also, due to the requirement that this new alloy be stronger than IN718, castings of the new alloy could replace IN718 castings, with a weight savings and at equal or less cost.

A development program was initially conducted to examine the possibility of investment casting IN718 into large structural components for gas turbine engines. Even after solving many casting related problems, porosity, segregation, and inclusions were still present in the castings at undesirable levels. In castings which solidified slowly, a significant amount of Laves phase was present in interdendritic areas. As is pointed out in the aforementioned co-pending application, LAVES FREE CAST + HIP NICKEL BASE SUPERALLOY, Laves phase significantly degrades the weldability and mechanical properties of castings. Defects such as porosity and inclusions are also detrimental to mechanical properties; all three of these defect types must be eliminated if the use of large IN718 cast components is to become practicable.

The alloys of the present invention result from a program to develop alloys which are stronger in the cast + HIP + heat treated condition than similarly processed IN718, and which have tensile properties which approach those of wrought IN718 products. Also, the alloys must be capable of being cast into large, complex, and near-net shapes, and must be weldable.

DISCLOSURE OF THE INVENTION

The alloys of the present invention are modifications of the IN718 composition. Castings made of the invention alloys are useful in the non-wrought condition. In the cast + HIP + heat treated condition, these articles have significantly improved tensile properties compared to similarly processed IN718 articles. These improvements result from increasing the Cb+Ta content to levels up to about 6.5%, and by increasing the Ti content to levels up to about 2.5%. Tungsten may optionally be present in amounts up to about 6.5%. The alloys have a reduced tendency for the precipitation of Laves phase during solidification, as compared to IN718; this is achieved by limiting the Cr content in the alloys to between about 10–15%, and by decreasing the minimum Mo content to zero. The composition range for the alloys of the invention is, by weight percent, 5.25–6.25 Cb+Ta, 0.65–2.25 Ti, 0–6.5 W, 10–15 Cr, 0–3.3 Mo, 15–24 Fe, 0.2–0.8 Al, with the balance Ni+Co.

The alloys of the invention are uniquely useful in that they may be cast into large, complex shapes, and are weldable. In the HIP'd + heat treated condition, articles having this composition exhibit at least about a 25% increase in 1,200° F. tensile properties compared to similarly processed IN718. As a result, the alloys may be used in applications which require better properties than cast IN718, or equivalent properties to wrought IN718.

The foregoing and other features and advantages of the present invention will become more apparent in the light of the following detailed description of the preferred embodiments thereof as illustrated in the accompanying drawing.

BEST MODE FOR CARRYING OUT THE INVENTION

The alloys of the present invention are compositional modifications of the alloy IN718; in the cast + HIP + heat treated condition, articles having the invention composition have tensile properties which are significantly better than similarly processed IN718.

In order to identify a castable alloy composition which had better tensile properties than cast + HIP + heat treated IN718, a laboratory test program was conducted to determine the effect of various elements on the mechanical properties of castings having a composition similar to the average IN718 composition. Metallographic examination of these new alloys was also conducted to examine their propensity for Laves phase formation.

The compositions of the alloys evaluated are presented in Table I, as is the composition for IN718 specimens which were evaluated as a baseline. As is seen in the Table, the nominal Cb+Ta content in cast IN718 is 5.0 weight percent. Increased Cb+Ta contents of 5.5 and 6 weight percent were evaluated. The typical Ti content in IN718 is 1.0 weight percent, and alloys containing 1.5 and 2 weight percent Ti were evaluated. Alloys containing up to 6 weight percent Mo, and up to 6 weight percent W were evaluated. Chromium was reduced to 12 weight percent in some of these alloys. Iron was fixed at 18 weight percent, and Ni+Co was the "balance element". All alloys contained C.

The results of tensile tests conducted at 1,200° F. on specimens having the composition of the alloys of Table I are presented in Table II. As is seen in the Table, with only minor exceptions, all of the modified alloys had 0.2% yield strengths and ultimate tensile strengths which were improved compared to the IN718 baseline. The ductility measurements (i.e., elongation and reduction in area) for the modified alloys were, in general, reduced relative to the IN718 baseline. This was not unexpected, however, due to increased tensile properties of the modified alloys.

Figure 1B:
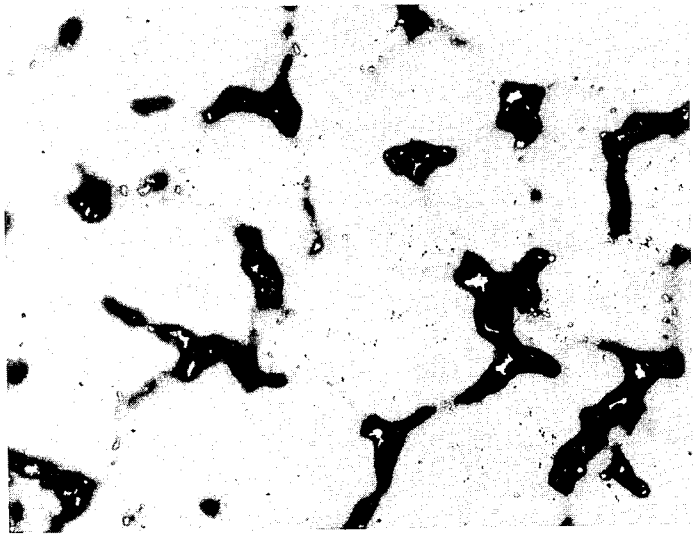
FIGS. 1 and 1*b* are photomicrographs (100X) showing the effect of chromium content on Laves phase formation.
Figure 1A:
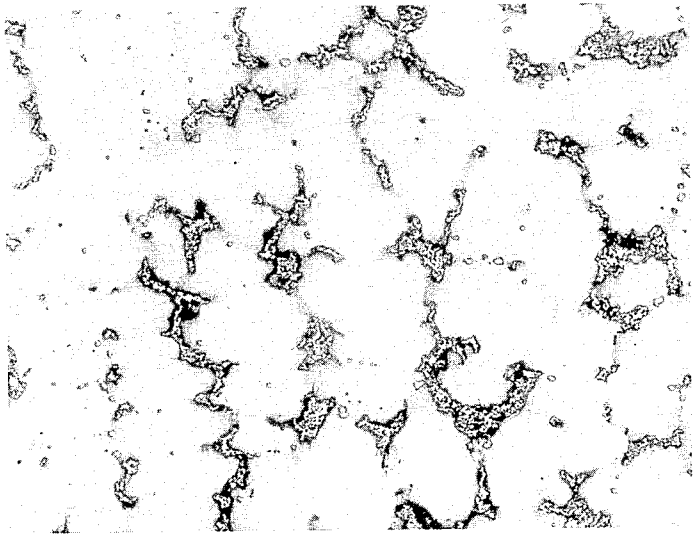
Figure 2A:
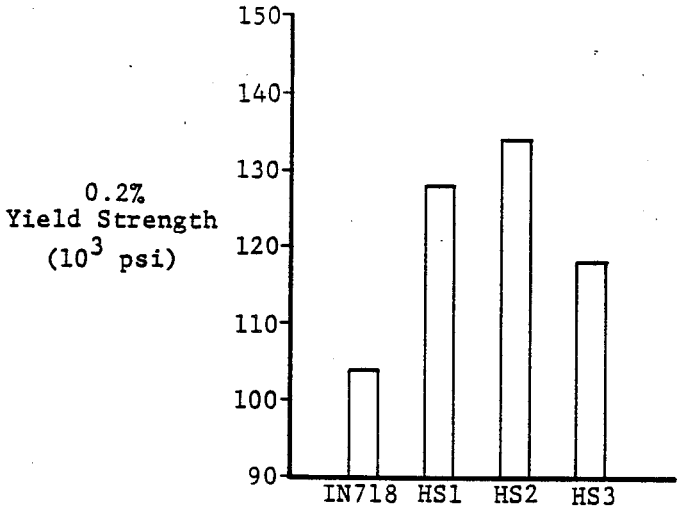
FIGS. 2*a*–2*d* are graphical representations of the tensile data of Table V.
Figure 2B:
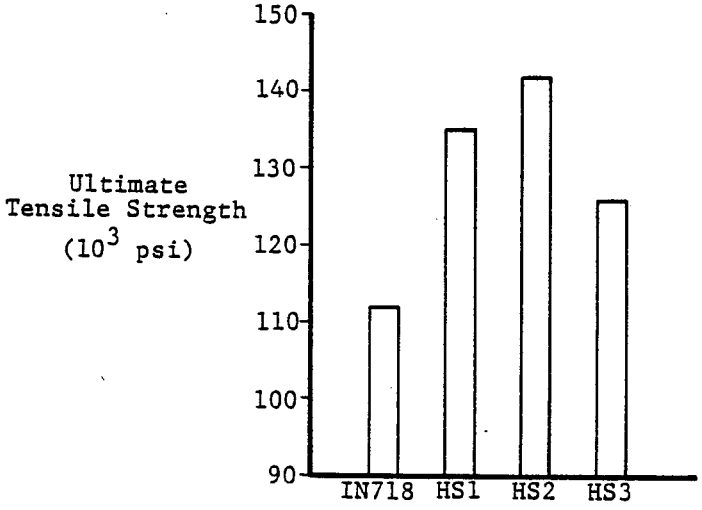
Figure 2C:
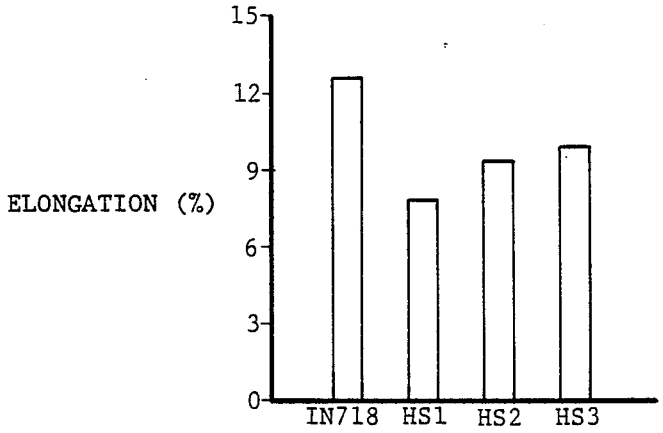
Figure 2D:
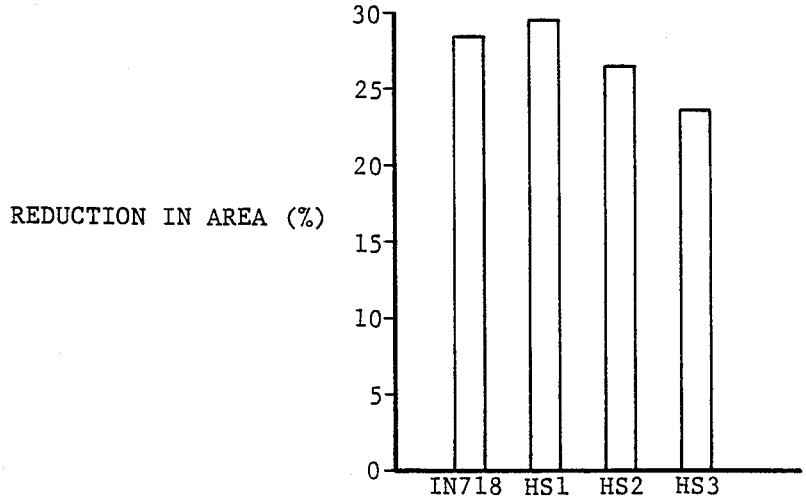

Metallographic examination of the alloys of Table II indicated that chromium exerted a significant influence on the amount of Laves phase in the as-cast microstructure. This was surprising, since as is known from the above referenced, copending application, the primary elements in Laves phase are Ni and Cb. The effect of Cr in these alloys can be seen in FIGS. 1*a* and 1*b*. The specimens shown these figures were prepared using standard metallographic techniques. To highlight the Laves phase precipitate, the specimens were electrolytically etched with an aqueous solution containing 10% oxalic acid. In these photomicrographs, the Laves phase appears as the white phase in interdendritic regions. The dark phase surrounding the Laves is predominantly the gamma double prime strengthening phase, $Ni_3Cb$. The matrix phase in IN718 is a nickel solid solution, gamma. As is seen in the Figures, in an alloy containing 19% Cr, (Alloy 13 in Table I) there is a substantial amount of Laves phase in the microstructure, in the form of an interconnected network of precipitate. In an alloy containing 12% Cr (Alloy 9 in Table I) the amount of Laves phase is considerably decreased. Also, the Laves phase in the Alloy 9 specimen is present as isolated pools of precipitate, as compared to the interconnected network for Alloy 13.

As a result of the increase in mechanical properties produced by the increased Cb, Ti, and W contents, and the decrease in Laves phase caused by the decreased Cr content, 250 pound vacuum induction melted (VIM) heats of material were prepared. The target composition range for these heats is given in Table III. The actual chemistry for the heats, referred to as HS 1, HS 2, and HS 3, are also given in the Table.

As seen in the Table, all three alloys contained about 12% Cr; the alloys designated HS1 and HS3 contained about 3% Mo while the alloy designated HS2 contained about 1% Mo. HS1 and HS2 contained nearly 6% Cb+Ta and 2% Ti, while HS3 contained about 5.5 Cb+Ta and 1.5 Ti. Otherwise, the compositions were similar to a typical IN718 composition, except for the fact that, as in the alloys of Table I, the Fe content was fixed at about 18, and Ni+Co was the "balance" element.

To determine the mechanical properties of these modified alloys relative to IN718, two different engine components (which in current engines are cast IN718) were investment cast using techniques known in the art. Components of all four alloys (IN718, HS1, HS2 and HS3) were cast under substantially identical conditions, and then HIP'd at 2,175° F. for 4 hours at 15,000 psi to close non-surface connected porosity. Following the HIP treatment, each component was heat treated to optimize mechanical properties. The heat treatment for IN718 specimens comprised a stabilization treatment at 1,600° F. for 10 hours, a solution treatment at 1,750° F. for 1 hour, and a precipitation (aging) treatment at 1,350° F. for 8 hours, followed by a furnace cool at a rate of at least 100° F. per hour to 1,225° F., holding at 1,225° F. for 8 hours, and the cooling to room temperature. The heat treatment for all three modified alloys was similar to that for IN718, except that the stabilization treatment was eliminated, and the solution treatment took place at 1,925° F. for 1 hour; the aging treatment was the same as for IN718. The results of tensile tests conducted at 70° and 1,200° F. are presented in Tables IV and V. In FIGS. 2*a*–2*d*, the 1,200° F. data from Table V has been averaged, and plotted in the form of a bar chart.

For use in modern gas turbine engines, cast + HIP + heat treated IN718 should have a minimum 1,200° F. 0.2% yield strength of about 90,000 psi, and a minimum 1,200° F. ultimate tensile strength of about 100,000 psi. Reference to Tables IV and V, and to FIGS. 2*a*–2*d*, indicates that the alloys of the invention, in the cast + HIP + heat treated condition, exceed these minimum property requirements by at least 25%. The alloy HS2, which had the best 0.2% yield strength and ultimate tensile strength of the three modified alloys at 1,200° F., exceeded these minimum property requirements by more than 37%. The ductility of the three modified alloys is comparable to the ductility of IN718.

A comparison of the 1,200° F. tensile properties reported in Table II with those of Table V reveals some differences, even though the alloy compositions (Tables I, III) were similar. The observed differences are believed to be attributable to the fact that the solidification rate for the specimens of Table II was faster than the solidification rate for the specimens of Table V. The faster solidification rate resulted in a finer as-cast grain size, and better tensile properties.

Metallographic examination of as-cast HS1, HS2, and HS3 specimens revealed that due to their lower Cr content relative to IN718, they contained less Laves phase precipitate than the similarly processed IN718 castings. This was in agreement with the observations made with respect to the specimens shown in FIG. 1.

The modified alloys were judged to have the same castability as IN718. "Castability" is a measure of the capability of an alloy to fill a mold and solidify without the formation of hot tears or excessive shrinkage porosity. In general, the fewer the number of defects detected, the better the alloy castability. In tests to evaluate the relative castability of the invention alloys with IN718, all materials successfully filled their molds and contained a comparable number of surface and subsurface defects. Thus, it was concluded that the alloys had comparable castability.

Large structural castings having the composition of the alloys of the present invention may be produced using casting techniques known in the art. A preferred method is to melt virgin stock by vacuum induction melting (VIM) and solidifying the melt in an investment casting mold. While the use of virgin stock is preferred, it is believed that revert, or scrap, material may also be used.

To close as-cast, non-surface connected porosity in the castings, the component should be HIP'd after casting. One HIP treatment which has yielded favorable reduction in porosity is 2,175° F. for 4 hours at 15,000 psi. However, those skilled in the art will recognize that other temperature, time, and pressure combinations may yield equally favorable results.

Because large, complex castings may contain as-cast defects such as surface connected porosity or inclusions, they must be weldable to repair such defects. As is known from the co-pending application LAVES FREE CAST + HIP NICKEL BASE SUPERALLOYS, the presence of Laves phase in the as-cast microstructure significantly increases the tendency for weld outgassing and generation of weld splatter. According to Vincent, "Precipitation Around Welds In The Nickel Base Superalloy, Inconel 718", Acta Metallurgica Volume 33, No. 7, pp. 1205–1216 (1985), Laves phase is also linked to the formation of heat affected zone microcracks. Tests conducted to date suggest that Laves phase will not form in the alloys of this invention to the extent which will adversely affect weldability. As a result, these alloys are considered to be weldable. It should be noted that the commonly assigned and co-pending application U.S. Ser. No. 565,589, PRE-HIP HEAT TREATMENT OF SUPERALLOY CASTINGS, describes a heat treatment for dissolving as-cast Laves phase into the alloy matrix; the contents of this application are incorporated by reference.

If defects such as porosity or inclusions are found in the casting after HIP'ing, such defects may be removed by e.g., abrasive grinding. These areas may then be weld repaired using, e.g., arc welding techniques. It is preferred that weld filler metal (e.g., wire or rod) which has a composition within the range specified in Table III be used, in order to avoid any incompatibilities between the weld bead and base metal. Prior to welding, the component is preferably heat treated at 1,925° F. for 1 hour (air cool). Following weld repair, the component is reinspected and if no further defects are found, the component is heat treated to optimize mechanical properties, according to the following schedule: 1,925°+25° F./1hour, followed by 1350°±25° F./8 hours (furnace cool at a rate of about 100° F. per hour to 1225° F.), followed by 1225°±25° F./8 hours (air cool).

Because of the desirable mechanical properties of cast articles having the composition of the invention, and in view of their weldability, they are useful in the fabrication of large, complex castings for use in turbomachinery such as gas turbine engines. They are particularly useful in the fabrication of components such as diffuser cases and rotor disks.

Although the invention has been shown and described with respect with a prefered embodiment thereof, it should be understood by those skilled in the art that other various changes and omissions in the form and detail thereof may be made therein without departing from the spirit and scope of the invention.

TABLE I

MODIFIED ALLOY COMPOSITIONS, WEIGHT PERCENT

| Alloy | Cb + Ta | Ti | Mo | W | Cr | Al | C | Fe | Ni + Co |
|---|---|---|---|---|---|---|---|---|---|
| 1* | 5.0 | 1.04 | 3.0 | 0.0 | 19.0 | 0.42 | 0.052 | 18.1 | Balance |
| 2 | 5.0 | 1.04 | 3.0 | 6.0 | 12.0 | 0.41 | 0.048 | 18.1 | Balance |
| 3 | 5.0 | 1.03 | 6.0 | 0.0 | 12.0 | 0.38 | 0.049 | 18.1 | Balance |
| 4 | 5.0 | 1.03 | 6.0 | 6.0 | 19.0 | 0.40 | 0.062 | 18.1 | Balance |
| 5 | 5.0 | 2.02 | 3.0 | 0.0 | 12.0 | 0.40 | 0.040 | 18.2 | Balance |
| 6 | 5.0 | 2.04 | 3.0 | 5.9 | 19.0 | 0.40 | 0.062 | 18.1 | Balance |
| 7 | 5.0 | 2.03 | 6.0 | 0.0 | 19.0 | 0.36 | 0.053 | 18.1 | Balance |
| 8 | 5.0 | 2.00 | 6.0 | 6.0 | 12.0 | 0.39 | 0.046 | 18.1 | Balance |
| 9 | 6.0 | 1.04 | 3.0 | 0.0 | 12.0 | 0.42 | 0.052 | 18.1 | Balance |
| 10 | 6.0 | 1.00 | 3.0 | 6.0 | 19.0 | 0.42 | 0.064 | 18.0 | Balance |
| 11 | 6.0 | 1.01 | 6.0 | 0.0 | 19.0 | 0.39 | 0.062 | 17.9 | Balance |
| 12 | 6.0 | 1.00 | 6.0 | 6.0 | 12.0 | 0.40 | 0.040 | 18.0 | Balance |
| 13 | 6.0 | 2.00 | 3.0 | 0.0 | 19.0 | 0.41 | 0.062 | 17.9 | Balance |
| 14 | 6.0 | 1.99 | 3.0 | 6.2 | 12.0 | 0.41 | 0.046 | 18.0 | Balance |
| 15 | 6.0 | 2.00 | 6.0 | 0.0 | 12.0 | 0.40 | 0.054 | 18.0 | Balance |
| 16 | 6.0 | 2.00 | 6.0 | 6.0 | 19.0 | 0.40 | 0.055 | 18.0 | Balance |
| 17 | 5.5 | 1.47 | 4.5 | 3.0 | 15.5 | 0.42 | 0.046 | 18.0 | Balance |
| 18 | 5.5 | 1.50 | 4.5 | 3.0 | 15.5 | 0.40 | 0.048 | 18.0 | Balance |

*Typical IN718 composition

TABLE II 1,200° F. TENSILE PROPERTIES OF MODIFIED ALLOY COMPOSITIONS IN CAST + HIP + HEAT TREATED CONDITION*

| Alloy | 0.2% Yield Strength ($10^3$ psi) | Ultimate Tensile Strength ($10^3$ psi) | Elongation (%) | Reduction In Area (%) |
|---|---|---|---|---|
| 1 | 118.5 | 133.1 | 9.5 | 22.0 |
| 2 | 150.9 | 162.6 | 9.0 | 14.3 |
| 3 | 120.6 | 132.6 | 12.5 | 16.1 |
| 4 | 117.4 | 148.5 | 8.7 | 10.3 |
| 5 | 139.9 | 152.5 | 7.0 | 12.1 |
| 6 | 141.4 | 161.3 | 7.7 | 5.3 |
| 7 | 133.2 | 145.8 | 6.0 | 2.7 |
| 8 | 147.3 | 161.5 | 6.0 | 7.8 |
| 9 | 149.3 | 159.0 | 6.4 | 10.3 |
| 10 | 144.8 | 164.4 | 6.1 | 6.7 |
| 11 | 138.9 | 152.5 | 5.2 | 5.6 |
| 12 | 147.1 | 154.6 | 5.3 | 6.8 |
| 13 | 146.5 | 154.7 | 10.2 | 21.9 |
| 14** | >154.7 | >155.1 | >2.1 | >3.0 |
| 15 | 159.2 | 163.4 | 6.5 | 21.5 |
| 16 | 141.9 | 168.8 | 2.0 | 1.4 |
| 17 | 141.9 | 154.0 | 5.3 | 9.6 |

*Specimens heat treated to solutionize delta phase.
**Specimen failed prematurely.

TABLE III

| ELEMENT | HIGH STRENGTH ALLOY CCMPOSITIONS, WEIGHT PERCENT COMPOSITION RANGE | HS1 | HS2 | HS3 |
|---|---|---|---|---|
| Tungsten | 0.0–6.5 | 0.0 | 0.0 | 0.0 |
| Colubium + Tantalum | 5.25–6.25 | 5.76 | 5.94 | 5.28 |
| Titanium | 0.65–2.25 | 1.91 | 1.90 | 1.44 |
| Chromium | 10.0–15.0 | 12.3 | 12.2 | 12.2 |
| Molybdenum | 0.0–3.30 | 2.96 | 1.12 | 2.95 |
| Iron | 15.0–24.0 | 18.3 | 17.9 | 18.5 |
| Aluminum | 0.20–0.80 | 0.50 | 0.54 | 0.52 |
| Carbon | 0.0–0.08 | 0.04 | 0.04 | 0.04 |
| Cobalt | 0.0–1.00 | <0.10 | <0.10 | <0.10 |
| Nickel + Cobalt | Balance | Balance | Balance | Balance |
| Manganese | 0.0–0.35 | 0.02 | 0.02 | 0.02 |
| Silicon | 0.0–0.35 | 0.02 | 0.03 | 0.04 |
| Phosphorus | 0.0–0.015 | <0.01 | <0.01 | <0.01 |
| Sulfur | 0.0–0.015 | 0.003 | 0.004 | 0.003 |
| Boron | 0.0–0.006 | 0.002 | 0.003 | 0.002 |
| Copper | 0.0–0.10 | <0.10 | <0.10 | <0.10 |
| Zirconium | 0.0–0.05 | <0.05 | <0.05 | <0.05 |
| Lead | 0.0–0.0010 | <0.001 | <0.001 | <0.001 |
| Bismuth | 0.0–<0.5 ppm | <0.5 ppm | <0.5 ppm | <0.5 ppm |
| Selenium | 0.0–0.0003 | <0.0003 | <0.0003 | <0.0003 |

TABLE IV

ALLOY TENSILE PROPERTIES AT 70° F.; SPECIMENS MACHINED FROM CAST + HIP + HEAT TREATED ENGINE COMPONENTS

| Alloy | 0.2% Yield Strength ($10^3$ psi) | Ultimate Tensile Strength ($10^3$ psi) | Elongation (%) | Reduction In Area (%) |
|---|---|---|---|---|
| IN718 | 124.9 | 138.3 | 11.3 | 25.9 |
| IN718 | 138.4 | 149.1 | 8.4 | 11.7 |
| IN718 | 138.6 | 149.3 | 7.5 | 12.4 |
| HS1 | 154.9 | 166.4 | 9.0 | 21.7 |
| HS1 | 169.5 | 180.7 | 5.8 | 16.5 |
| HS1 | 167.1 | 175.4 | 8.5 | 26.8 |
| HS2 | 159.1 | 164.4 | 8.0 | 26.5 |
| HS2 | 173.8 | 181.1 | 9.0 | 19.7 |
| HS2 | 173.8 | 179.9 | 10.8 | 28.9 |
| HS3 | 148.7 | 163.0 | 14.0 | 26.7 |
| HS3 | 151.1 | 162.2 | 14.8 | 21.9 |

TABLE V

ALLOY TENSILE PROPERTIES AT 1,200° F.; SPECIMENS REMOVED FROM CAST + HIP + HEAT TREATED ENGINE COMPONENTS

| Alloy | 0.2% Yield Strength ($10^3$ psi) | Ultimate Tensile Strength ($10^3$ psi) | Elongation (%) | Reduction In Area (%) |
|---|---|---|---|---|
| IN718 | 107.3 | 117.9 | 13.4 | 34.3 |
| IN718 | 99.0 | 107.3 | 14.6 | 29.3 |
| IN718 | 106.2 | 111.5 | 10.7 | 21.9 |
| IN718 | 103.1 | 112.5 | 12.0 | 28.9 |
| HS1 | 122.5 | 127.7 | 8.3 | 35.8 |
| HS1 | 131.2 | 138.1 | 8.5 | 33.2 |
| HS1 | 128.6 | 133.9 | 7.0 | 20.4 |
| HS1 | 134.9 | 140.6 | 7.5 | 28.1 |
| HS2 | 130.6 | 136.7 | 9.0 | 27.3 |
| HS2 | 137.7 | 146.6 | 8.6 | 28.7 |

TABLE V-continued

ALLOY TENSILE PROPERTIES AT 1,200° F.; SPECIMENS REMOVED FROM CAST + HIP + HEAT TREATED ENGINE COMPONENTS

| Alloy | 0.2% Yield Strength ($10^3$ psi) | Ultimate Tensile Strength ($10^3$ psi) | Elongation (%) | Reduction In Area (%) |
|---|---|---|---|---|
| HS2 | 132.6 | 138.3 | 9.5 | 31.4 |
| HS2 | 134.3 | 146.2 | 10.6 | 18.3 |
| HS3 | 119.6 | 126.0 | 9.0 | 24.4 |
| HS3 | 117.9 | 126.1 | 11.0 | 23.2 |

We claim:

1. A method for making a cast, gamma double prime-gamma prime strengthened nickel base superalloy article useful in the non-wrought condition, the method comprising the steps of:

(a) melting and solidifying an alloy having a composition consisting essentially of, by weight percent, 0.0–3.3 Mo, 15–24 Fe, 0.2–0.8 Al, 0.65–2.25 Ti, 5.5–6.5 Cb+Ta, 10–15 Cr, 0–6.5 W, with the balance Ni+Co, wherein the high Ti and Cb contents promote the formation of the gamma double prime and gamma prime phases in the microstructure, and the low Cr content suppresses the formation of Laves phase in the microstructure;

(b) HIP'ing the cast alloy at conditions to close as-cast, subsurface porosity; and (c) heat treating to optimize mechanical properties.

2. The method of claim 1, further comprising the step of weld repairing the casting.

3. The article made by the method of claim 1.

4. The article made by the method of claim 2.

5. A cast, HIP'd, and heat treated nickel base superalloy article consisting essentially of, by weight percent, 0.0–3.3 Mo, 15–24 Fe, 0.2–0.8 Al, 0.65–2.25 Ti, 5.5–6.5 Cb+Ta, 10–15 Cr, 0–6.5 W, balance Ni+Co.

6. A welded, high strength cast article substantially free from weld cracks, consisting essentially of, by weight percent, 0.0–3.3 Mo, 15–24 Fe, 0.2–0.8 Al, 0.65–2.25 Ti, 5.5–6.5 Cb+Ta, 10–15 Cr, 0–6.5 W, balance Ni+Co.

* * * * *